United States Patent [19]

Chamdru

[11] 4,177,857

[45] Dec. 11, 1979

[54] BLOW NOZZLE, NOTABLY FOR FOUNDRY CORES

[75] Inventor: Jacques Chamdru, Le Mesnil St. Denis, France

[73] Assignee: Regie Nationale des Usines Renault, Zola, France

[21] Appl. No.: 830,795

[22] Filed: Sep. 6, 1977

[30] Foreign Application Priority Data

Sep. 13, 1976 [FR] France ..... 76 27461

[51] Int. Cl.[2] ..... B22C 15/24

[52] U.S. Cl. ..... 164/200

[58] Field of Search ..... 164/200; 403/4

[56] References Cited

U.S. PATENT DOCUMENTS

| | | | |
|---|---|---|---|
| 1,720,422 | 7/1929 | Manville | 403/4 |
| 3,235,921 | 2/1966 | Bego et al. | 164/200 |

*Primary Examiner*—Robert D. Baldwin
*Assistant Examiner*—J. Reed Batten, Jr.
*Attorney, Agent, or Firm*—Stevens, Davis, Miller & Mosher

[57] ABSTRACT

The blow nozzle for use notably in foundry works in the so-called hot-box process for manufacturing sand molds and cores comprises a central barrel or tube on which a pair of tubular sleeves adapted to slide in relation to each other are fitted. These sleeves comprise diametrally opposite elongated notches and are indexed and secured to the filling tray of the hot box by means of a tip holder on which a plastic tip is resiliently fitted.

7 Claims, 9 Drawing Figures

BLOW NOZZLE, NOTABLY FOR FOUNDRY CORES

The present invention relates to metal blow nozzles or jets and is concerned more particularly with a blow nozzle adjustable in length, common to all diameters and of the forced cooling-fluid circulation type, for foundry cores, this type of nozzle being adapted to be mounted on a filling tray utilized for blowing sand in the so-called hot-box method for manufacturing sand molds and cores.

In U.S. Pat. No. 3,987,842 applicant discloses a nozzle or jet device comprised of a pair of tubular plastic, respectively male and female, sleeves, assembled concentrically and shaped to provide an intermediate annular space therebetween permitting an efficient cooling water circulation, the male sleeve being provided at its bottom with a plastic tip or end-piece capable of withstanding severe abrasive and thermal stresses.

In French Patent application No. 75/11176 filed on Apr. 10, 1975 and its Certificate of Addition No. 75/23421 filed on July 28, 1975, both in the assignee's name, there is described a blow nozzle comprising a fitting cone merging into the substantially cylindrical external portion via a substantially circular shoulder in resilient engagement with the upper wall of the core frame, thus providing the necessary scaling contact by bearing horizontally on said core frame.

However, so far as applicant is aware, longitudinally adjustable blow nozzles capable of facilitating the proper positioning of the impact points for the filling operation have not been proposed heretofore.

The blow nozzle according to the present invention is characterized in that it comprises a tubular support or barrel on which a pair of tubular sleeves having each a pair of diametrally opposite slots are adapted to be fitted, said tubular sleeves constituting a male member and a female member, respectively, adapted to slide on each other, and being indexed and secured to the filling tray by means of an endpiece carrier adapted to be engaged by a plastic tip, endpiece or base member.

In hitherto known blow nozzles according to the type and core size, the impact points for the filling operation have variable diameters; the smaller the diameter of the sand passageway, the greater the risk of hardening the sand feed column. The nozzle according to this invention avoids this inconvenience since all the sand passageways upstream of the impact point are relatively large throughout the conduit length; only the impact constrictions are formed in the tip or endpiece.

The tip or endpiece utilized in the device of this invention is of the type disclosed in French Patent application No. 75/11176 filed by the assignee and made preferably of a suitable fluorinecontaining elastomer of the type manufactured by Dupont de Nemours under the trademark "VITON". When utilizing the nozzle in systems operating without curing but wherein the cores are hardened by applying a chemical process, this tip or endpiece may consist of polyurethane elastomer, P.V.C. (polyvinyl chloride) or similar material.

On the other hand, in most instances the impact points on the core lie at different levels. In order to provide access to these various levels, it is possible, by varying the operating height of the rear bearing faces of the nozzles in the plate constituting the filling tray, to meet the requirements arising from different impact levels on the core. However, it appears that this possibility is sometimes inconsistent with the desired core shapes. This problem is also solved by using the blow nozzle of the instant invention wherein the male and female sleeves are slidably mounted on and each other enclose the tube or barrel, so that the latter can be replaced and a distance-piece of a length corresponding to the increment in length of the tube can be added, the gauge and thickness of this distance-piece corresponding to those of the female sleeve, thus providing a new nozzle.

A clearer understanding of this invention will be had as the following description proceeds with reference to the attached drawing illustrating diagrammatically by way of example a typical form of embodiment of a blow nozzle constructed according to the teachings of the invention. In the drawing.

Figure 1:
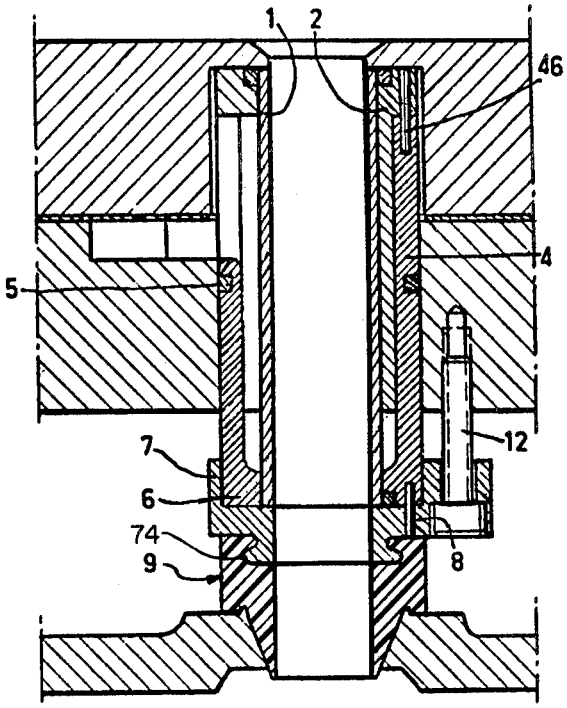
FIG. 1 is a vertical axial section showing the blow nozzle of this invention, mounted on the filling tray.
Figure 4:
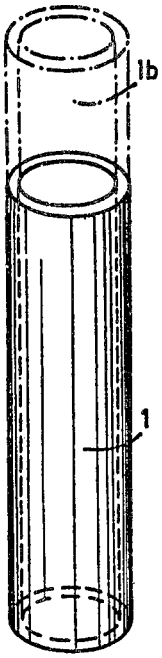
FIG. 4 is a further perspective view of the tube or barrel of the same nozzle.
Figure 5:
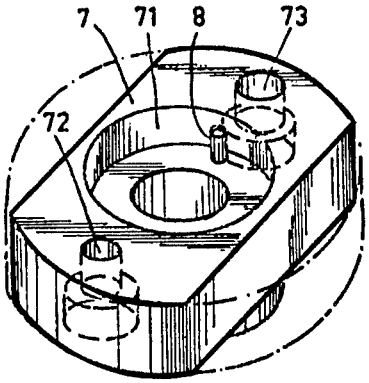
FIG. 5 is a perspective view of the tip or endpiece carrier of FIG. 1.
Figure 6:
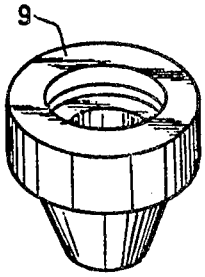
FIG. 6 is a perspective view of the tip or endpiece of FIG. 1.
Figure 2:
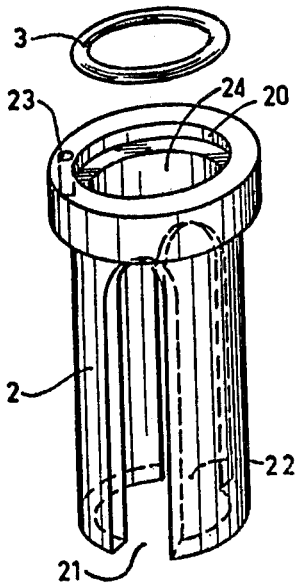
FIG. 2 is a perspective view of the male sleeve of the nozzle of FIG. 1.
Figure 3:
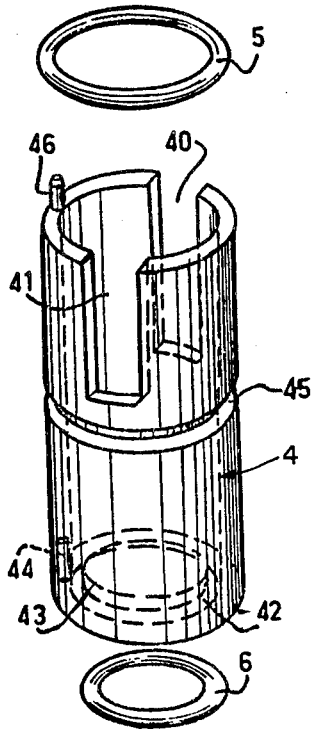
FIG. 3 is another perspective view of the female sleeve of FIG. 1.

The blow nozzle according to the present invention comprises a central tube or barrel 1 having a diameter common to all the diameters selected as a function of the sand core. Surrounding this barrel 1 are a male sleeve 2 and a female sleeve 4 formed with diametrally opposite slots; these sleeves are indexed and secured to the filling tray by means of an endpiece or tip holder 7 on which a plastic tip or endpiece 9 of fluorinecontaining elastomer is fitted.

The diametrally opposite slots 21, 22 of sleeve 2 and 40, 41 of sleeve 4 form together a passageway towards the nozzle base, and are kept in mutual alignment by means of a centering stud or pin 46 carried by the upper annular surface of sleeve 4 and adapted to engage an orifice 23 formed in the flanged top portion 20 of sleeve 2 for indexing purposes. Similarly, the centering stud or pin 8 projecting from the annular surface of the chambered cavity 71 of tip holder 7 is adapted to engage a blind hole 44 formed in the bottom annular surface of sleeve 4.

Figure 9:
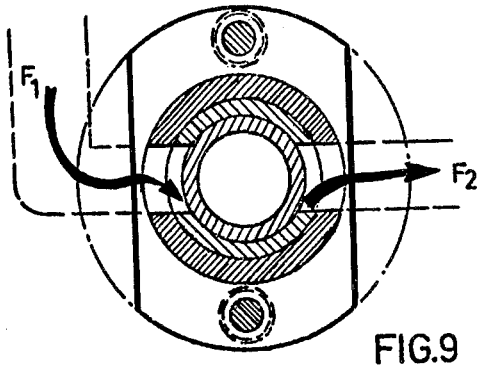
Figure 7:
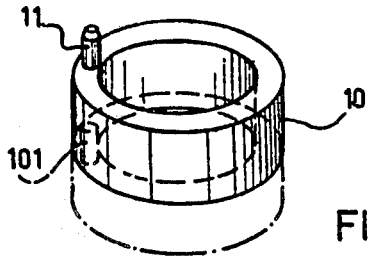
FIG. 7 is a perspective view of a distance-piece intended for use in the nozzle of this invention.
Figure 8:
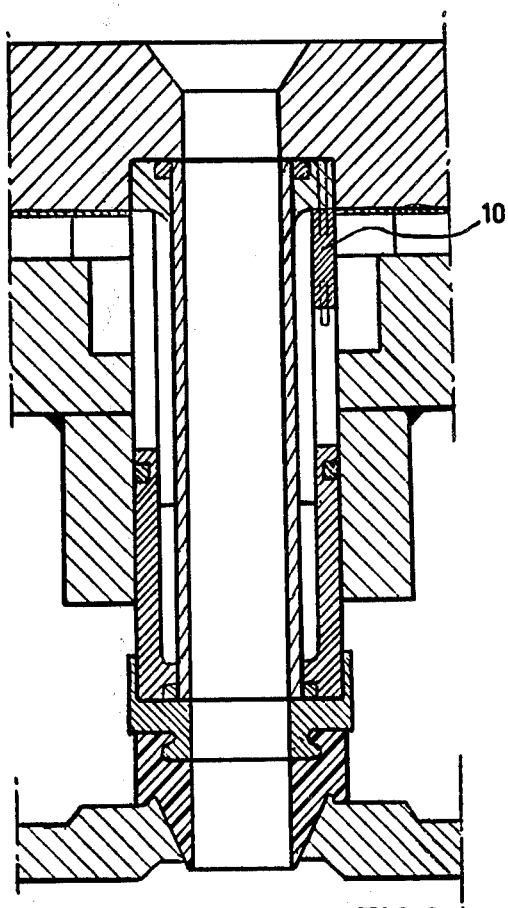
FIG. 8 is a vertical axial section of the nozzle according to this invention, provided with the distance-piece of FIG. 7; and, FIG. 9 is a cross-section taken substantially at mid-height of the nozzle illustrated in FIG. 1.

In the drawing, the arrows $F_1$, $F_2$ (FIG. 9) designate the direction of flow of the cooling fluid.

The nozzle is locked in position by means of a pair of diametrally opposite screws 12 extending through plain holes of tip holder 7, another function of these screws consisting in providing the final indexation of the component elements of the nozzle.

The tops or endpieces 9 having an external body of same outer diameter and same height for all the desired inner diameters afford an accurate vertical adjustment of the nozzle.

The upper end of the nozzle is sealed against the passage of both sand and cooling fluid by means of a static O-ring 3.

The lower end of the nozzle is also sealed by means of a static O-ring 6 having the same functions as ring 3 towards the sand and cooling fluid. This O-ring 6 engages an annular cavity 42 formed in sleeve 4.

Externally, this sleeve 4 is sealed by means of an O-ring 5 engaging a groove 45.

The central tube or barrel 1 should not under any circumstances have the same length as sleeves 2 and 4. A minimum play must be provided so that the sleeves 2 and 4 can bear against the bottom of a chambered cavity formed in the top plate of the filling tray so as to compress the top O-ring 3.

The male and female sleeves 2, 4 are mounted for mutual sliding movement and the tube or barrel 1 is surrounded by the bores 24 and 43 of sleeves 2 and 4, respectively.

Another barrel 1*b* obtained by cutting a tube having the same properties may be substituted for the barrel 1. Thus, after causing the sleeve 2 and 4 to slide in relation to each other, the nozzle can be elongated by fitting on male sleeve 2 a tubular distance-piece 10 of suitable length or height and having the same thickness as the female sleeve 4, but an outer diameter slightly smaller to avoid a tedious fitting. Projecting from the flange-shaped top portion of this distance-piece is a positioning stud or pin 11 adapted to engage companion orifice 23 for indexing the male sleeve 2. On the bottom annular face of this distance-piece a blind hole 101 of relatively small diameter is engageable by the centering pin of stud 46 of sleeve 4, in order to preserve the proper orientation of slots 21 and 22 of sleeve 2 and also that of slots 40 and 41 of outer sleeve 4, the final orientation being in all cases obtained through the tip holder 7 by means of its stud or pin 8 and its inner cavity 71 and the pair of screws 12 engaging the holes 72 and 73 of this holder.

The VITON tip is resiliently retained in position by the bead 74 of tip holder 7.

When a nozzle having a length greater than the standard length is desired, suitable bosses or like projections must be provided or fitted under the bottom plate of the filling tray to afford a rational and rigid positioning of the O-ring 6 engaging the outer sleeve 4.

This extension of the nozzle length makes it necessary to provide in the cooling circuit consisting of grooves milled in the bottom plate a number of suitable small cuts in order to reach the slots 40, 41 of sleeve 4 and, in fact, slots 21 and 22 of sleeve 2.

Flat faces having the desired relative spacing may be provided between any pair of adjacent nozzles on the tip holder 7. For the sake of convenience, i.e. avoiding any subsequent machining step, these flat faces may be formed during the initial steps of the manufacture of the tip holders.

All the bores formed in the plates constituting the filling tray have the same diameter, only the depths vary as a function of the core to be formed.

If desired, some play may be reserved in the bore, according to the height at which the nozzle is to be fitted, in the uppermost plate of the filling tray. Similarly, a slight clearance for introducing the rear portion of the nozzle will cause only a minor loss at the cooling fluid passage, but the fitting of the various nozzles in position will be facilitated appreciably. If the nozzles are inserted through the lower plate of the filling tray, it is unnecessary to provide some play for the passage of the rear portion of the nozzle, the latter bearing against the upper plate of the filling tray.

The fluid-tightness between the two plates constituting the filling tray is obtained by means of a relatively thin flat gasket tied at proper locations with due consideration for the positions of the various nozzles.

Possibly the reverse positioning of one or more nozzles may be located on a higher plane in relation to the other nozzles. In this case, the inserted projection will be located on the top plate of the tray, and grooves of the cooling circuit leading to those formed in the bottom plate will be milled or otherwise machined in the form of small cuts, and the relative position of the tip holder 7 will require more or less deep chamberings in order properly to assemble the parts for tightening the complete nozzle by means of a pair of screws. However, considering the flowing of sand above the filling tray, said arrangement should preferably be located on a smooth horizontal plane.

Although a specific form of embodiment of this invention has been described hereinabove and illustrated in the accompanying drawing, it will readily occur to those skilled in the art that various modifications and changes may be brought thereto without departing from the scope of the invention as set forth in the appended claims.

What is claimed is:

1. In a blow nozzle intended for foundry use according to the so-called hot-box process in the manufacture of sand molds and cores having a central replaceable barrel member which can be of different lengths and a surrounding sleeve means to provide cooling fluid in contact with said barrel member, the improvement wherein said surrounding sleeve means comprises a female sleeve provided with diametrally opposite slots and a male sleeve in sliding relation to said female sleeve provided with diametrally opposite slots, and further comprising index means to maintain the slots formed in said sleeves in mutual alignment, and tip holder means to secure said sleeves to a hot-box filling tray, said tip holder means having a resiliently fitting plastic tip whereby the length of the nozzle can be adjusted by using barrels having different lengths.

2. A nozzle as set forth in claim 1, wherein said index means comprises an orifice formed in the male sleeve and a centering stud carried by the female sleeve which is adapted to engage the orifice of the male sleeve and a blind hole formed at the lower portion of the female sleeve and a centering stud in the tip holder means engaging said blind hole.

3. A nozzle as set forth in claim 2, wherein said male sleeve has a flange extending over the end wall of the female sleeve, said centering stud carried by the female sleeve extending from the end wall of the female sleeve and said orifice in the male sleeve being positioned in said flange.

4. A nozzle as set forth in claim 3, wherein the barrel is of a length requiring a tubular distance-piece, said distance-piece being located between the flange of the male sleeve and the end wall of the female sleeve, the length of said tubular distance-piece corresponding to the difference in length between the barrel and the female sleeve, said tubular distance-piece having approximately the same thickness as said female sleeve, but a slightly smaller outer diameter.

5. A nozzle as set forth in claim 4, wherein said tubular distance-piece has a centering stud on one end and a blind hole on the other, said stud of the tubular distance-piece engaging the orifice in the flange of the male sleeve and the centering stud on the female sleeve engaging the blind hole in the tubular distance-piece.

6. A nozzle as set forth in claim 1, wherein the material of said plastic tip is polyurethane elastomer or polyvinyl chloride.

7. A nozzle as set forth in claim 1, wherein the material of said plastic tip is a fluorine-containing elastomer.

* * * * *